United States Patent [19]

Abreu et al.

[11] Patent Number: 4,724,457

[45] Date of Patent: Feb. 9, 1988

[54] DEVELOPER UNIT USING THREE ANGERS IN THREE CHAMBERS

[75] Inventors: Christian O. Abreu, Rochester; Cyril G. Edmunds, Webster; Mark A. Scheuer, Williamson, all of N.Y.

[73] Assignee: Xerox Corporation, Stamford, Conn.

[21] Appl. No.: 922,421

[22] Filed: Oct. 23, 1986

[51] Int. Cl.[4] ..... G03G 15/08

[52] U.S. Cl. ..... 355/3 DD; 118/657

[58] Field of Search ..... 355/3 DD; 118/645, 653, 118/656, 657, 658

[56] References Cited

U.S. PATENT DOCUMENTS

| | | | |
|---|---|---|---|
| 3,333,566 | 8/1967 | Kent | 118/2 |
| 3,664,299 | 5/1972 | Shaler et al. | 118/657 |
| 3,883,240 | 5/1975 | Ito et al. | 355/3 DD |
| 3,999,514 | 12/1976 | Abbott et al. | 355/3 DD |
| 4,101,211 | 7/1978 | Kayson | 355/3 DD |
| 4,659,211 | 4/1987 | Oka | 118/657 |

FOREIGN PATENT DOCUMENTS

| | | | |
|---|---|---|---|
| 54-30838 | 3/1979 | Japan . | |
| 846141 | 8/1960 | United Kingdom | 118/656 |

*Primary Examiner*—William H. Beha, Jr.

*Attorney, Agent, or Firm*—H. Fleischer; J. E. Beck; R. Zibelli

[57] ABSTRACT

An apparatus in which a latent image recorded on a member is developed with a developer material comprising at least carrier granules and toner particles. Toner particles are dispensed into the developer housing and mixed with unused developer material. The toner particles and developer material are advanced along an extended path so that the toner particles are gently mixed and triboelectrically charged to substantially the nominal level prior to contacting the latent image. A system of this type is particularly useful for toner particles requiring extensive gentle mixing to achieve the desired triboelectric charge.

4 Claims, 3 Drawing Figures

DEVELOPER UNIT USING THREE ANGERS IN THREE CHAMBERS

This invention relates generally to an electrophotographic printing machine, and more particularly concerns an apparatus for developing an electrostatic latent image.

In an electrophotographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing marking particles into contact therewith. This forms a powder image on the photoconductive member which is subsequently transferred to a copy sheet. The copy sheet is heated to permanently affix the marking particles thereto in image configuration.

Various types of development systems have hereinbefore been employed. These systems utilize two component developer mixes or single component developer materials. Typical two component developer mixes employed are well known in the art, and generally comprise dyed or colored thermoplastic powder, known in the art as toner particles, which are mixed wih coarser carrier granules, such as ferromagnetic granules. The toner particles and carrier granules are selected such that the toner particles acquire the appropriate charge relative the electrostatic latent image recorded on the photoconductive surface. When the developer mix is brought into contact with the charged photoconductive surface the greater attractive force of the electrostatic latent image recorded thereon causes the toner particles to transfer from the carrier granules and adhere to the electrostatic latent image.

Heretofore, development systems have employed rotary impellers, for brushes, bucket conveyors and magnetic brush systems to achieve the requisite uniformity in toner deposition. Magnetic brush systems achieve a high degree of uniform deposition and, therefore, numerous electrophotographic printing machines utilize this type of development system. Usually, a magnetic brush system includes a developer roller having a directional flux field to bring the magnetizable developer mix into contact with the charged photoconductive surface. In an electrophotograhic printing machine adapted to produce highlight colors, a portion of the copy is reproduced in a color other than the remainder of the copy. For example, in a document containing text, selected portions of the text may be reproduced in red while the remainder of the text is reproduced in black. The copy will have selected portions highlighted in red. This may be achieved by employing two development systems. One development system employs black toner particles with the other development system employing red toner particles, or toner particles of any other selected color. Generally, the printing process is a two cycle process. During one cycle, the black portions of the copy are reproduced on the copy sheet and during the other cycle, the red portions of the copy are reproduced to form a copy having both red and black regions thereon. One difficulty with a system of this type is that the toner particles used to form the highlight color regions are frequently insufficiently charged or have a shortened life. It has been found that these toner particles require extensive gentle mixing to achieve the requisite triboelectric charge and life. While hard mixing will achieve the requisite triboelectric charge, it foreshortens the useful life of the developer material. In contradistinction, gentle mixing does not foreshorten the useful life of the developer material, but usually precludes the toner particles from acquiring the necessary triboelectric charge prior to being advanced into contact with the electrostatic image recorded on the photoconductive surface. This results in poorly developed latent images. The apparatus of the present invention is designed to provide a solution to these diametrically opposite requirements. Various types of techniques have been developed to achieve development in electrophotographic printing machines. The following disclosures appear to be relevant: U.S. Pat. No. 3,333,566 to Kent, issued: Aug. 1, 1967; U.S. Pat. No. 3,883,240 to Ito et al., issued: May 13, 1975; U.S. Pat. No. 4,101,211 to Kayson issued: July 18, 1978 Japanese Patent Publication No. 54-30838 to Hoshino Published: Mar. 7, 1979.

The relevant portions of the foregoing disclosures may be briefly summarized as follows:

Kent, Ito et al. and Hoshino all describe systems using dual parallel augers with a single developer applicator roller. The augers rotate in opposite directions with toner particles supplied to the applicator roller by the auger with the most thoroughly mixed developer material. New toner particles are added at the input end of the other auger to ensure thorough mixing.

Kayson teaches a dual auger, dual applicator roller system with a paddle wheel located between the augers at one end thereof.

Pursuant to the features of the present invention, there is provided an apparatus for developing a latent image recorded on a member. The apparatus includes a housing defining a chamber for storing a supply of developer material comprising at least carrier granules and toner particles therein. Means, located in one region of the chamber of the housing, dispense toner particles into the chamber of the housing. Means, located in the chamber of said housing in a region remote from the dispensing means, transport developer material closely adjacent to the member so that the latent image attracts toner particles from the developer material to form a toner powder image on the member. Means, located in the chamber of said housing, mix and advance the toner particles and carrier granules. The mixing and advancing means receives at least a portion of the toner particles from the dispensing means and mixes these toner particles with the developer material in the chamber of the housing as the mixing and advancing means advances the toner particles and developer material along an extended path from the region of the dispensing means to the region of the transporting means so that the toner particles advanced to the transporting means are gently mixed and triboelectrically charged to substantially the nominal level at the transporting means.

In accordance with another aspect of the present invention, there is provided an electrophotographic printing machine of the type having a development system which develops an electrostatic latent image recorded on a photoconductive member. The printing machine includes a housing defining a chamber for storing a supply of developer material comprising at least carrier granules and toner particles therein. Means, located in one region of the chamber of the housing, dispense toner particles into the chamber of the housing. Means, located in the chamber of the housing in a region remote from the dispensing means, transport developer material closely adjacent to the photoconductive member so that the latent image attracts toner particles from the developer material to form a toner powder image on the photoconductive member. Means, located in the chamber of the housing, mix and advance the toner particles and carrier granules. The mixing and advancing means receives at least a portion of the toner particles from the dispensing means and mixes these toner particles with the developer material in the chamber of the housing as the mixing and advancing means advances the toner particles and developer material along an extended path from the region of the dispensing means to the region of the transporting means so that the toner particles advanced to the transporting means are gently mixed and triboelectrically charged to substantially the nominal level at the transporting means.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
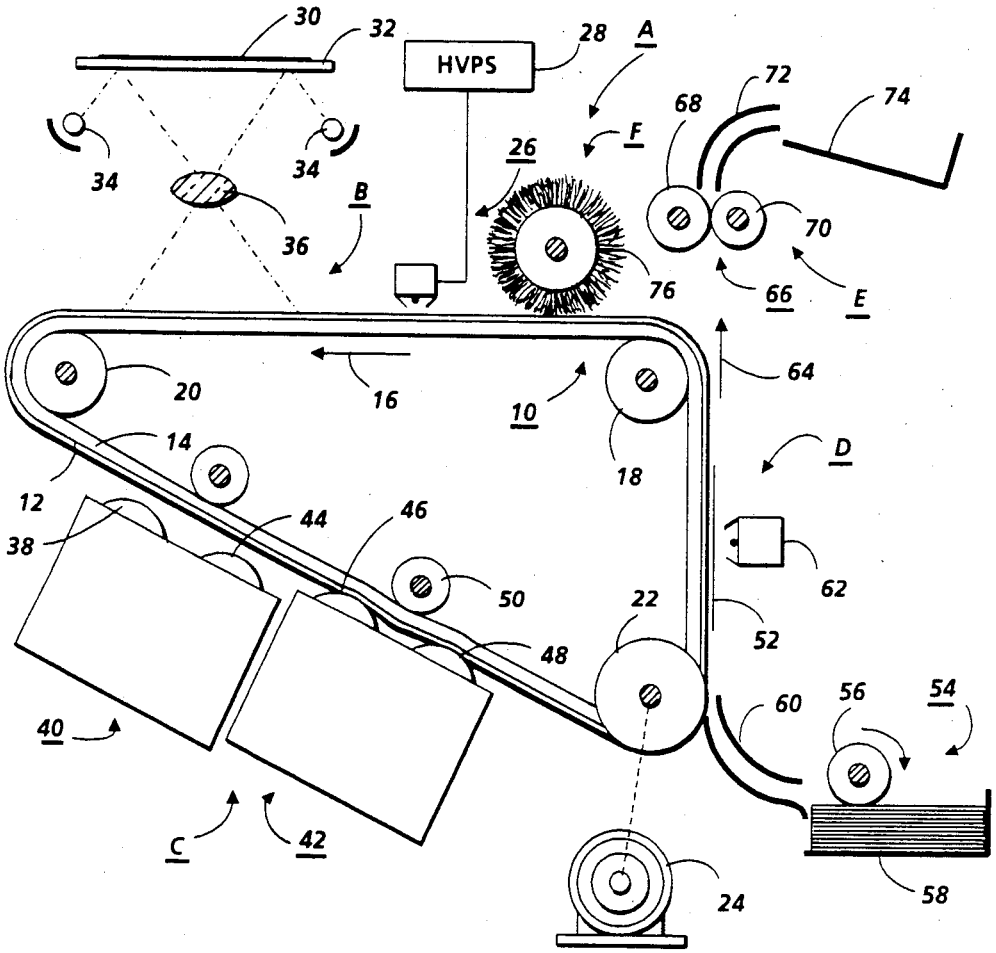
FIG. 1 is a schematic elevational view depicting an electrophotographic printing machine incorporating the development apparatus of the present invention therein.

For a general understanding of the features of the present invention, reference is made to the drawings. In the drawings, like references have been used throughout to designate identical elements. FIG. 1 schematically depicts the various components of an illustrative electrophotographic printing machine incorporating the development apparatus of the present invention therein. It will become evident from the following discussion that the development apparatus of the present invention is equally well suited for use in a wide variety of electrostatographic printing machines, and is not necessarily limited in its application to the particular electrophotographic printing machine shown herein.

Inasmuch as the art of electrophotographic printing is well known, the various processing stations employed in the FIG. 1 printing machine will be shown hereinafter schematically and their operation described briefly with reference thereto.

Referring now to FIG. 1, the electrophotographic printing machine employs a belt 10 having a photoconductive surface deposited on a conductive substrate 14. Preferably, photoconductive surface 12 is made from a selenium alloy. Conductive substrate 14 is made preferably from an aluminum alloy which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensing roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive device surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selective dissipate the charge thereon. This records an electrostatic latent image on photoconductive surface 12 with corresponds to the informational areas contained within original document 30.

After the electrostatic latent image has been recorded on photoconductive surface 12, belt 10 advances the latent image to development station C. At development station C, magnetic brush developer units, indicated generally by the reference numerals 40 and 42, are selectively operatable to advance developer material of different colors into contact with the latent image. By way of example, developer unit 40 is shown cammed to an inoperative position wherein rollers 38 and 44 are spaced a sufficient distance from photoconductive surface 12 so as to prevent development of the latent image recorded thereon. Development unit 42 is shown in the operative position wherein belt 10 is entrained about a portion of rollers 46 and 48. Idler roller 50 presses belt 10 into engagement with rollers 46 and 48. This forms an extended development zone. By way of example, developer unit 40 develops the latent image with black toner particles whereas developer unit 42 develops the latent image with highlight color toner particles, e.g. red. In this way, a color highlight copy may be created. This achieved by masking a selected portion of the original document desired to be reproduced in red. Thus, all of the portions of the original document desired to be reduced in black are illuminated during the first cycle. Developer unit 40 is located in the operative position and developer unit 42 in the inoperative position. This latent image is developed with the black toner particles. Thereafter, the original document is remasked with the areas previously reproduced in black covered and those previously masked uncovered. At this time, developer unit 40 is in the inoperative position and developer unit 42 is in the operative position. Thus, the resultant second latent image is now developed with red toner particles. The black toner particles developed on the first latent image and red toner particles on developed on the second latent image are transferred to a copy sheet forming a copy color highlighted in red. Alternatively, the areas desired to be reproduced in red can be designated on an edit pad. The edit pad transmits the coordinates of the red regions. During the first cycles, the designated red regions of the latent image are erased and only the black regions remain on the latent image. This latent image is developed with black toner particles. During the next cycle, the black regions are erased and only the red regions of the latent image remain recorded on the photoconductive surface. This latent image is now developed with red toner particles. Developer rollers 46 and 48 are adapted to advance developer material into contact with the latent image. These developer rollers form a brush of carrier granules and toner particles extending outwardly therefrom. The latent image attracts the toner particles from the carrier granules forming a toner powder image thereon. The details of developer unit 42 will be described hereinafter with reference to FIGS. 2 and 3.

With continued reference to FIG. 1, after the electrostatic latent image is developed belt 10 advances the toner powder image to transfer station D. A sheet of support material 52 is advanced to transfer station D by sheet feeding apparatus 54. Preferably, sheet feeding apparatus 54 includes a feed roll 56 contacting the uppermost sheet of stack 58. Feed roller 56 rotates to advance the uppermost sheet from stack 58 into chute 60. Chute 60 directs the advancing sheet of support material into contact with photoconductive surface 12 of belt 10 in a timed sequence so that the toner powder image contacts the advancing sheet of support material at transfer station D. Transfer station D includes a corona generating device 62 which sprays ions onto the backside of sheet 52. This attracts the toner powder image from photoconductive surface 12 to sheet 52. After transfer, sheet 52 continues to move in the direction of arrow 64 onto a conveyor (not shown) which advances sheet 52 to fusing station E.

Fusing station E includes a fuser assembly, indicated generally by the reference numeral 66, which permanently affixes the transferred powder image to sheet 52. Preferably, fuser assembly 66 comprises a heated fuser roller 68 and a back-up roller 70. Sheet 52 passes between fuser roller 68 and back-up roller 70 with the toner powder image contacting fuser roller 68. In this way, the toner powder image is permanently affixed to sheet 52. After fusing, chute 72 advances sheet 52 to catch tray 74 for subsequent removal from the printing machine by the operator. If a color highlighted copy is being reproduced, the copy sheet returns to the transfer station in a timed sequence with the next developed latent image to have the color highlighted toner particles transferred thereto.

After the sheet of support material is separated from photoconductive surface 12 of belt 10, the residual toner particles adhering to photoconductive surface 12 are removed therefrom at cleaning station F. Cleaning station F includes a rotatably mounted fibrous brush 76 in contact with photoconductive surface 12. The particles are cleaned from photoconductive surface 12 by the rotation of brush 76 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present invention to illustrate the general operation of an electrophotographic printing machine incorporating the features of the present invention therein.

Figure 2:
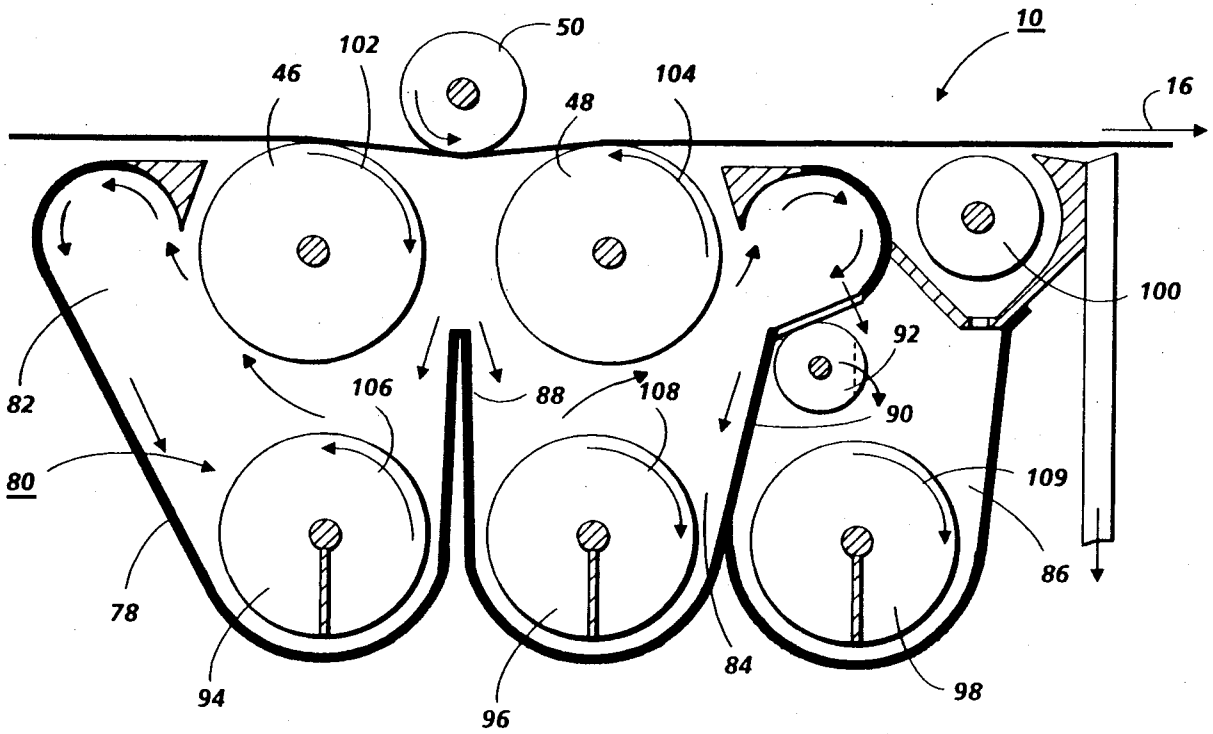
FIG. 2 is a schematic elevational view showing the development apparatus used in the FIG. 1 printing machine.

Referring now to FIG. 2, there is shown developer unit 42 in greater detail. As shown thereat, developer unit 42 includes a housing 78 defining a chamber, indicated generally by the reference numeral 80. Chamber 80 is divided into three individual chamber portions 82, 84 and 86. Each chamber portion is independent and separated from one another so as to prevent co-mingling of the developer material in adjacent chamber portions. Baffle plate 88 separates chambers 82 and 84 from one another. Baffle plate 90 separates separates chambers 84 and 86 from one another. Developer roller 46 is disposed in chamber portion 82. Developer roller 48 is located in chamber portion 84. A toner particle dispenser 92 is positioned in chamber portion 86 and adapted to furnish additional toner particles to the developer material therein. Mixing and advancing auger 94 is located in chamber portion 82. Mixing and advancing auger 96 is located in chamber portion 84. Mixing and advancing auger 98 is located in chamber portion 86. A pick-off magnet 100 is positioned above chamber portion 86 adjacent photoconductive surface 12 of belt 10. The pick-off magnet 100 removes residual carrier granules adhering to photoconductive surface 12 of belt 10 and discharges these carrier granules into chamber portion 86. A blower system is coupled to chamber 80 to maintain it at a negative pressure insuring that particles do not escape therefrom but remain therein. Developer rollers 46 and 48 are substantially identical to one another. Developer roller 46 includes a tubular member rotating in the direction of arrow 102. A stationary cylindrical magnet is disposed interiorly of the tubular member. As the tubular member rotates in the direction of arrow 102, developer material is advanced into contact with the latent image recorded on photoconductive surface 12 of belt 10. The residual or unused developer material and carrier granules denuded of toner particles are returned to chamber portion 82 for mixing with new toner particles and recirculation back to developer roller 46. Similarly, developer roller 48 includes a tubular member rotating in the direction of arrow 104. A stationary cylindrical magnet is disposed interiorly thereof. As the tubular member rotates in the direction of arrow 104, developer material is advanced into contact with the photoconductive surface of belt 10. The latent image attracts the toner particles from the carrier granules. Unused developer material and carrier granules denuded of toner particles are returned to chamber portion 84 for subsequent recirculation to developer roller 48. Augers 94, 96 and 98 are substantially identical to one another. Auger 94 includes a spiral or helical member disposed in a tube having the upper region thereof opened. As the helical member rotates in the direction of arrow 106, developer material and toner particles are mixed with one another and advanced from one end of auger 94 to the other end thereof. As the helical member thereof rotates in the direction of arrow 106, auger 94 receives developer material and toner particles from augers 96 and 98. Augers 96 and 98 receive developer material and toner particles from auger 94. Auger 96 includes a tube having the upper end and open ended with a spiral or helical member disposed interiorly thereof. The spiral or helical member rotates in the direction of arrow 108 to advance developer material or toner particles from one end of chamber portion 84 to the other end thereof. Auger 96 receives developer material and toner particles from auger 94. Auger 96 advances developer material and toner particles to auger 94. Auger 98 includes a closed tube having a spiral or helical member disposed interiorly thereof and adapted to rotate in the direction of arrow 109 so as to advance developer material and toner particles from one end thereof to the other end thereof. The toner particles being dispensed by toner dispenser 92 are received at one end of auger 98 and mixed with developer material received from developer roller 104 and carrier granules received from the pick-off magnet 100. In this way, the newly furnished toner particles from toner dispenser 92 must move from one end of auger 98 to the other end thereof. Auger 98 receives developer material and toner particles from auger 94 and advances develper material and toner particles to auger 94. In this way, newly furnished toner particles from toner dispenser 92 must travel the entire length of auger 98, at a minimum, before being received by developer roller 102. This ensures that the toner particles are gently mixed and achieve the desired triboelectric charge thereon prior to being advanced by developer roller 46 into the development zone.

Figure 3:
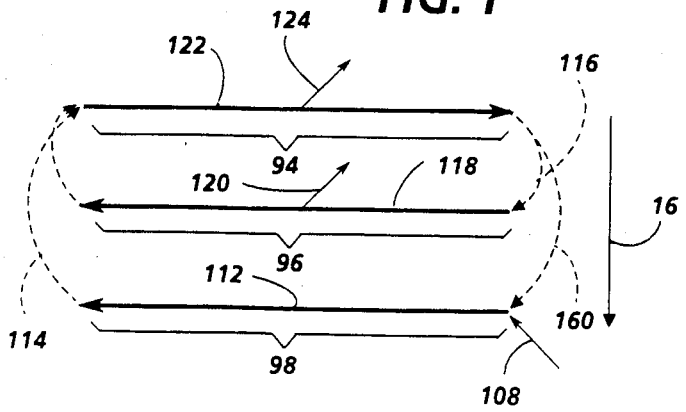
FIG. 3 is a flow diagram illustrating the flow of the developer material in the FIG. 2 development apparatus.

Referring now to FIG. 3, there is shown a flow diagram of the developer material and toner particles in each of the augers. As depicted, the process direction, i.e. the direction, the direction of movement of belt 10 is in the direction of arrows 16. Toner particles are added to auger 98 at one end thereof as shown by arrow 108. Auger 98 also receives developer material from auger 94, as shown by arrow 160. Auger 98 advances the developer material and toner particles from one end thereof to the other end thereof as indicated by arrow 112. The toner particles and developer material which have been mixed in auger 98 are then advanced to auger 94, as shown by arrow 114. Auger 96 receives developer material from auger 94, as shown by arrow 116. Auger 96 advances and develops the material in the direction of arrow 118. Developer roller 48 attracts developer material thereto. This is shown by arrow 120. In addition, auger 96 advances developer material to auger 94. Auger 94 advances the developer material received from augers 96 and 98 in the direction of arrow 122. Developer roller 46 attracts developer material thereto. This is shown by arrow 124. The flow rate of the material in auger 98 is maintained at a slightly higher rate than the flow rate of the material in auger 96. This ensures that the overflow always goes from auger 96 to auger 98 rather than from auger 98 to auger 96.

The opposing flow directions in augers 94 and 96 result in a higher concentration of toner particles at the entrance to auger 94, a moderate concentration of toner particles at the exit of auger 94 and the entrance to auger 96, and a low concentration of toner particles at the exit of auger 96. This produces opposing toner concentration gradients on developer rollers 46 and 48 which result in a more uniform development of the electrostatic latent image recorded on photoconductive surface 12. In addition, the lower concentration of toner particles on developer roller 48, above the exit of auger 96, is directly downstream, in the direction of arrow 16, of the higher toner concentration on developer roller 46, above the entrance of the auger 94. This enables developer roller 48 to effectively scavenge excess background toner particles from photoconductive surface 12.

In recapitulation, it clear that the development system of the present invention includes an elongated path for advancing newly furnished toner particles so that the newly furnished toner particles are gently mixed with the developer material. As the toner particles are being advanced along this elongated or extended path, they acquire the desired triboelectric charge prior to their being advanced into the development zone by the respective developer rollers. In the development system of the present invention, the toner particles are gently mixed along an extended path. Thus, they have the opportunity to acquire the requisite triboelectric charge without the necessity of vigorous mixing.

It is, therefore, apparent that there has been provided in accordance with the present invention, an apparatus for developing an electrostatic latent image recorded on a photoconductive surface that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. A developer unit for use in an electrophotographic printing machine for developing a latent image recorded on a photoconductive member, including:

a housing defining a chamber separated into a first chamber portion, a second chamber portion, and a third chamber portion with each chamber portion being isolated from one another for storing a supply of developer material comprising at least carrier granules and toner particles therein;

means, located in said third chamber portion of said housing adjacent said second chamber portion of said housing, for dispensing toner particles into said third chamber portion of said housing;

a first developer roller disposed in said first chamber portion of said housing to transport developer material closely adjacent to the photoconductive member;

a second developer roller disposed in said second chamber portion of said housing adjacent said first chamber portion for transporting developer material closely adjacent to the photoconductive member;

a first auger positioned in said first chamber portion for mixing the toner particles and carrier granules of the developer material being advanced to said first developer roller;

a second auger positioned in said second chamber portion for mixing the toner particles and carrier granules of the developer material being advanced to said second developer roller and said first auger, said second auger receiving developer material from said first auger; and a third auger positioned in said third chamber portion for receiving toner particles from said dispensing means, developer material from said first auger, and developer material and carrier granules from said second developer roller, said third auger mixing the toner particles and carrier granules of the developer material being advanced to said first auger.

2. An apparatus according to claim 1, wherein said first auger advances developer material in a direction opposed to the direction that said second auger and said third auger advance developer material.

3. An apparatus according to claim 2, wherein said second auger advances developer material at a greater flow rate than said third auger so that the developer material overflowing from said second auger is received by said third auger.

4. An apparatus according to claim 3, further including means, disposed in said third chamber portion, for removing carrier granules adhering to the member and moving the carrier granules into said third chamber portion.

* * * * *